United States Patent [19]

Gilbertson

[11] Patent Number: 4,490,097

[45] Date of Patent: Dec. 25, 1984

[54] HYDRAULIC PUMP DRIVING UNIT FOR OIL WELLS

[76] Inventor: Thomas A. Gilbertson, 216 Sandringham, N., Moraga, Calif. 94566

[21] Appl. No.: 517,325

[22] Filed: Jul. 25, 1983

Related U.S. Application Data

[63] Continuation-in-part of Ser. No. 237,366, Feb. 23, 1981, abandoned.

[51] Int. Cl.[3] ..... F04B 47/04

[52] U.S. Cl. ..... 417/401; 166/68.5

[58] Field of Search ..... 166/68, 68.5, 84; 60/371, 372; 417/401

[56] References Cited

U.S. PATENT DOCUMENTS

| | | | |
|---|---|---|---|
| 805,267 | 11/1905 | Davis | 166/84 X |
| 1,312,442 | 8/1919 | Greenlee | 166/68 X |
| 1,627,945 | 5/1927 | Wigle | 166/84 |
| 2,287,709 | 6/1942 | Ringman | 91/291 X |
| 2,367,248 | 1/1945 | Vickers et al. | 60/372 |
| 2,699,154 | 1/1955 | Smith | 60/372 X |
| 2,869,469 | 1/1959 | Williams | 166/84 X |
| 4,305,461 | 12/1981 | Meyer | 166/84 |
| 4,320,799 | 3/1982 | Gilbertson | 166/68.5 |

*Primary Examiner*—Leonard E. Smith

*Attorney, Agent, or Firm*—Flehr, Hohbach, Test, Albritton & Herbert

[57] ABSTRACT

An oil well pump driving unit which includes a hydraulic cylinder mounting arrangement which eliminates the use of a stuffing box by mounting the cylinder by way of a mounting arrangement on top of a pumping tee at the wellhead which includes a cylinder rod sealing arrangement separate from the one in the hydraulic cylinder to preclude leakage of well fluid around the cylinder rod.

10 Claims, 8 Drawing Figures

HYDRAULIC PUMP DRIVING UNIT FOR OIL WELLS

This application is a continuation-in-part of my prior application Ser. No. 237,366, filed Feb. 23, 1981, now abandoned.

This invention relates to oil well pump driving units and, more specifically, to oil well pump driving units utilizing a hydraulic cylinder to produce a relatively slow pumping stroke.

One of the conventional styles of oil well pump driving units is the walking beam, horsehead unit in which the walking beam and horsehead are driven in a rocking motion. A cable arrangement running over the horsehead is utilized to raise and lower a polished rod which extends through a stuffing box arrangement mounted above the pumping tee located on the wellhead casing. The other end of the polished rod is connected to a sucker rod string which extends down hole and is mounted on the other end to one of the conventional types of reciprocating pumps.

This conventional type of pump driving unit comes in various sizes to produce various pump stroke lengths depending on the capacity of the well. For smaller wells, units with a stroke length between about twelve and twenty inches per stroke are used. For larger wells, pumping units with a stroke between forty and one hundred seventy inches per stroke may be used.

Typically, these horsehead pumping units are run at fairly high stroke rates of anywhere from about eight to twelve strokes per minute on the smaller units to twelve to thirty strokes per minute on the larger units. The rapid reciprocating motion of the rod string including the polished rod and the sucker rod string extending down the bore hole, produces certain undesirable operating effects. From a mechanical standpoint, this rapid reciprocation produces acceleration, shock and harmonic loading of the rod string with accompanying high peak rod loads, all of which shorten the life of the rod string. Moreover, it is well-known that the rapid pumping stroke of this type of pump driving unit reduces the volumetric pump efficiency due to the rate at which the pump is attempting to move oil up the tubing string and because of the agitation and pounding of the fluid in the well.

An additional problem that can be encountered in pumping wells containing light oil, i.e. oil which has a substantial volume of dissolved gas, is gas lock of the pump. Gas lock is generally caused by the gas released from the oil in the formation at a rapid rate as the pressure drops in the pump on the upstroke. If the pressure on the head of liquid in the bore hole is not sufficient to compress the gas released into the pump chamber on the upstroke, pressure of the expanded volume of gas at the top of the pump barrel will not exert sufficient pressure on the traveling valve to counteract the pressure of the fluid column on that valve. Consequently, the valve will not open and no fluid will be moved by the pump. Under this condition, the plunger in the pump merely compresses and expands the gas in the pump barrel. This gas lock problem can make it extremely difficult to pump down some very gaseous wells. Even if a complete gas lock does not occur, the buildup of gas in the pump barrel reduces substantially the effective oil pumping capacity due to the volume occupied by the gas.

Very large capacity wells, i.e. over two hundred barrels per day, justify the use of an expensive cable-type pumping unit, such as the Alpha Pump Unit manufactured by Bethlehem Steel Corporation, to produce a long, slow pump stroke. The Bethlehem Alpha Pumping Unit utilizes a pair of spiral cam arrangements mounted on a common shaft, each carrying a cable which is attached either to the sucker road string through a traveling stuffing box arrangement or to a counterweight arrangement which traverses a counterweight well which must be sunk into the ground near the wellhead. The Bethlehem Alpha rig is an expensive pump driving unit which is cost effective only in large capacity wells, but its typical forty-foot stroke and three per minute stroke rate produces a long, slow pump stroke cycle which eliminates the above-mentioned problems inherent in the horsehead, walking beam pumping units.

While the Bethlehem Alpha type of pumping unit is available for the larger wells, pump driving units for producing a relatively slow stroke for smaller wells were not, until recently, available on the commercial market. In some areas the characteristics of certain wells are such that a small walking beam pump unit simply performs so inefficiently in pumping the oil or is subject to intolerably repetitive gas lock conditions that the wells simply are unproductive and remain capped.

In a copending Gilbertson patent application entitled "Oil Well Pump Driving Unit", Ser. No. 148,380, filed May 9, 1980, an oil well pump driving unit utilizing a hydraulic cylinder to produce a relatively long, slow pumping stroke is disclosed. In this copending application, the hydraulic cylinder is mounted in a horizontal orientation adjacent the wellhead and is coupled to the sealed drive rod arrangement in a traveling piston-type stuffing box by way of a cable and sheave arrangement which translates the horizontal motion of the cylinder rod into a vertical motion for driving the rod string of the pumping arrangement. The hydraulic cylinder mounting arrangement and the coupling arrangement between the cylinder rod and the rod string disclosed therein provide an advantageous pumping action for relatively high capacity wells requiring a stroke length substantially greater than ten feet.

Certain prior art patents disclose oil well pump driving units in which a hydraulic cylinder is utilized to power the rod string driving the reciprocating pump at the bottom of the well. For example, Mason U.S. Pat. No. 1,708,584 and Palm U.S. Pat. No. 1,845,176 disclose oil well pump driving units in which a hydraulic cylinder is mounted directly over a pumping tee and stuffing box arrangement at the wellhead. In the Mason patent a very complicated structural arrangement utilizing a support tower is provided for supporting the hydraulic cylinder. Moreover, a double-acting hydraulic cylinder together with a counterweight arrangement supported on the steel tower structure is utilized in the Mason pump driving unit.

The Palm patent discloses a somewhat simpler mounting arrangement for the hydraulic cylinder but also discloses a complex structural arrangement for mounting counterweights which require the use of a double-acting cylinder. Moreover, in the Palm patent, the mounting flange of the hydraulic cylinder is apparently formed in an integral fashion with a horizontal support plate carrying two counterweight pulleys with the overall arrangement providing no apparent compensation for any alignment error between the support plate and the cylinder and the axis of the stuffing box and pumping tee arrangement. Both the support structure shown in the Mason patent and that disclosed in the Palm patent require a complicated assembly operation for mounting the hydraulic cylinder at the wellhead.

Williams U.S. Pat. No. 2,869,469 discloses a hydraulic cylinder mounted in an integral manner on the top end wall of a pumping tee. The Williams unit does not use a conventional off-the-shelf hydraulic cylinder, but instead uses special mounting flange components to integrate the cylinder into the pumping tee. Moreover, the Williams unit uses a single cylinder rod sealing arrangement for sealing against leakage of both hydraulic fluid and well fluid. Since seals are only partly effective, the well fluid will gradually seep past the seal and tend to contaminate the hydraulic fluid. This would reduce cylinder life.

In a second copending Gilbertson patent application entitled "Oil Well Pump Driving Unit", Ser. No. 183,958, filed Sept. 3, 1980, (now U.S. Pat. No. 4,320,799, issued Mar. 23, 1982) an oil well pump driving unit utilizing a hydraulic cylinder mounted directly over and in line with the pumping tee and stuffing box arrangement is disclosed. The pumping tee and stuffing box arrangement may comprise either a stationary stuffing box with sealing glans provided therein for cooperating with a polished rod connected between the sucker rod string and the hydraulic cylinder rod or it may comprise an inverted stuffing box arrangement involving a drive rod piston traveling in a polished tube having a length corresponding generally to the maximum pumping stroke length.

In this second copending Gilbertson patent application a support means is provided for supporting the hydraulic cylinder above the stuffing box with the axis of the cylinder rod aligned with the axis of the stuffing box. The support means includes a cylinder support plate and structural means mounting the cylinder support plate above the pumping tee and stuffing box arrangement with the plane of the support plate generally perpendicular to the axis of the stuffing box. A gimbal mounting means is positioned on the cylinder support plate for supporting the cylinder in an axially floating manner to adjust automatically the orientation of the axis of the cylinder to bring it into alignment with the axis of the stuffing box when the weight of the rod string is applied to the cylinder rod. The gimbal mounting arrangement automatically compensates for any small errors in the positioning of the cylinder support plate perpendicular to the axis of the stuffing box and the sealed drive rod extending therethrough.

The oil well pump driving unit disclosed in the second copending Gilbertson patent application is especially suitable for small wells having a relatively short stroke length of up to about ten feet. However, the pump driving unit requires the use of a stuffing box arrangement of some type and utilizes the gimbal mounting of the cylinder to provide automatic alignment of the cylinder and cylinder rod with the stuffing box.

It is a principal object of this invention to provide an improved oil well pump driving unit.

More specifically it is an object of this invention to provide an oil well pump driving unit with a simplified cylinder support arrangement for a standard hydraulic cylinder, including a cylinder rod sealing arrangement which eliminates the need for a separate stuffing box mounted to the pumping tee.

The pump driving unit of this invention is adapted to be utilized in an oil well pumping apparatus which includes a submerged reciprocating pump mounted at the bottom of the well in a tubing arrangement communicating with the wellhead, a sucker rod string extending through said tubing arrangement and connected in driving relation with the pump and a pumping tee mounted on the casing of the well at the wellhead and communicating with the tubing arrangement. One aspect of this invention features a pump driving unit which comprises a hydraulic cylinder, including a cylinder rod, and a support arrangement for supporting the hydraulic cylinder on the pumping tee with the axis of the cylinder rod aligned with the axis of the pumping tee and tubing arrangement. The hydraulic cylinder includes an in/out fluid line and a first cylinder rod sealing arrangement positioned within said mounting flange to preclude leakage of hydraulic fluid around said cylinder rod as it moves in and out through said mounting flange. The support arrangement includes a first fluid sealing arrangement engaging a top surface of the pumping tee for precluding well fluid leakage thereat and a second fluid sealing arrangement engaging the cylinder rod to provide a stuffing box-like arrangement for the cylinder rod which is integral with the support means and the pumping tee and precludes well fluid leakage around the cylinder rod. A coupling arrangement is provided for coupling the cylinder rod directly to the sucker rod string and a hydraulic drive/control system is coupled to the in/out fluid line of the cylinder for operating it to produce an operating cycle for the pump consisting of a hydraulic power upstroke and a gravity power downstroke.

Preferably, the support means for the cylinder comprises a first support plate mounted at the wellhead below the pumping tee and adapted to carry the weight of the hydraulic cylinder and the pumping load thereon together with a cylinder support plate assembly adapted to be mounted on the pumping tee and a vertical support arrangement for supporting the cylinder support plate assembly on the first support plate. The cylinder support plate assembly has a bottom surface with registration means formed thereon for producing registration between the cylinder support plate and the pumping tee and for carrying a first fluid sealing arrangement to seal the bottom surface against the top surface of the pumping tee. A cylinder rod channel extends through the cylinder support plate assembly to receive the cylinder rod and the second fluid sealing means is carried on the cylinder support plate assembly surrounding the cylinder rod channel to provide a fluid seal between the edge of the cylinder rod channel and the reciprocating cylinder rod.

Preferably the pumping tee has a top surface which has been machined flat and a top edge with a chamfer machined thereon. The registration means on the bottom surface of the cylinder support plate assembly preferably comprises a cylindrical recess machined into that surface, with the diameter of the recess matching the top surface of the pumping tee and angled sidewalls matching the chamfered top edge of the pumping tee. The first sealing arrangement is preferably a circular groove formed in the cylindrical recess and an O-ring carried in the circular groove for sealing against the machined top surface of the pumping tee.

In one embodiment, the cylinder support plate assembly comprises a base plate and a cylinder plate carried on the base plate with cooperating registration means for locating the cylinder plate with respect to the base plate. The second fluid sealing arrangement preferably comprises a cylindrical recess formed in a bottom surface of the cylinder plate and a gasket carried in the cylindrical recess to provide a fluid seal for the cylinder rod slidably extending therethrough. The top surface of the cylinder plate preferably has a recess formed therein closely matching the configuration of the cylindrical nose on the mounting flange of the hydraulic cylinder to provide accurate registration of the cylinder on the cylinder plate. The base plate and the cylinder plate have a plurality of apertures therethrough in registration with each other and with mounting apertures in the cylindrical mounting flange of the cylinder for receiving bolts to fasten the cylinder on the cylinder plate and to fasten the base plate and the cylinder plate together.

In a second embodiment the cylinder support plate assembly comprises a base plate mounted against the top surface of the pumping tee and the cylinder support arrangement carried on the base plate. Each of the base plate and the cylinder support plate arrangement have a channel extending therethrough for receiving the cylinder rod. The base plate includes the second cylinder rod sealing arrangement carried within the channel. The cylinder support arrangement includes an inspection aperture extending between an outer surface thereof and the cylinder rod channel to permit inspection of the cylinder rod for presence of any substantial quantity of well fluid which would indicate leakage of the second cylinder rod sealing arrangement.

Oil well pump driving units in accordance with this invention advantageously provide for self-alignment of the axis of the hydraulic cylinder with the axis of the pumping tee and tubing string at the wellhead. The mounting arrangement for the cylinder eliminates the need for a separate stuffing box arrangement and simplifies the assembly of the pump driving unit at the wellhead. The overall structural arrangement of the invention provides for rapid assembly of the pumping apparatus at the wellhead utilizing relatively unskilled labor. The assembly operation is simplified by the straightforward manner in which the various components fit together so that complete setup of the pump driving unit can be accomplished within a few hours of arrival of the components thereof at the wellhead. The pump driving unit of this invention has the advantageous long, slow pumping stroke which maximizes pumping efficiency. In addition, relatively simple timer controls may be utilized in the hydraulic/drive control unit to provide complete control over the pump stroke length and stroke rate as well as other operating parameters.

Other objects, features and advantages of this invention will be apparent from a consideration of the following detailed description in conjunction with the accompanying drawings.

Figure 1:
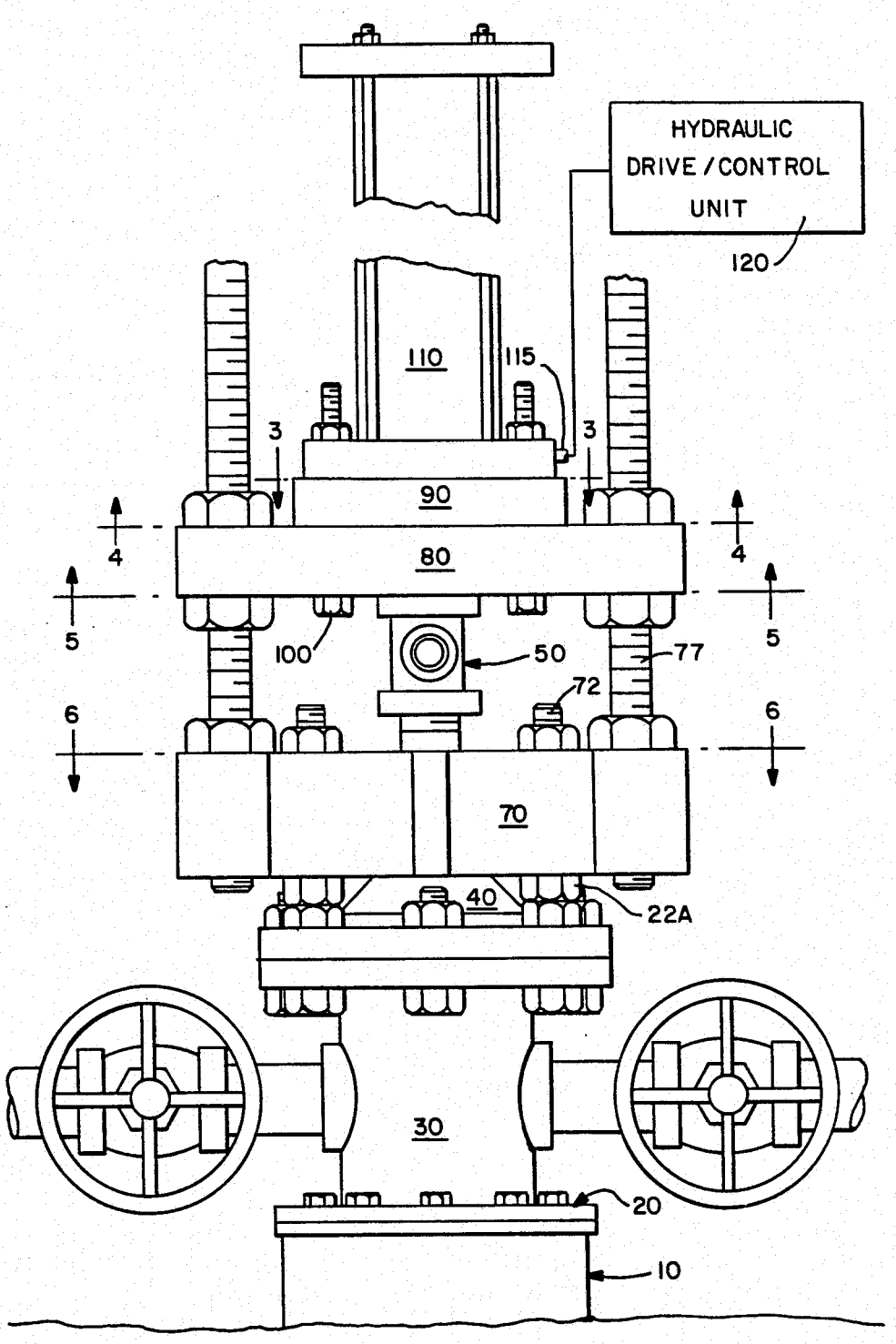
FIG. 1 is an elevational view of one embodiment of an oil well pump driving unit in accordance with this invention.
Figure 2:
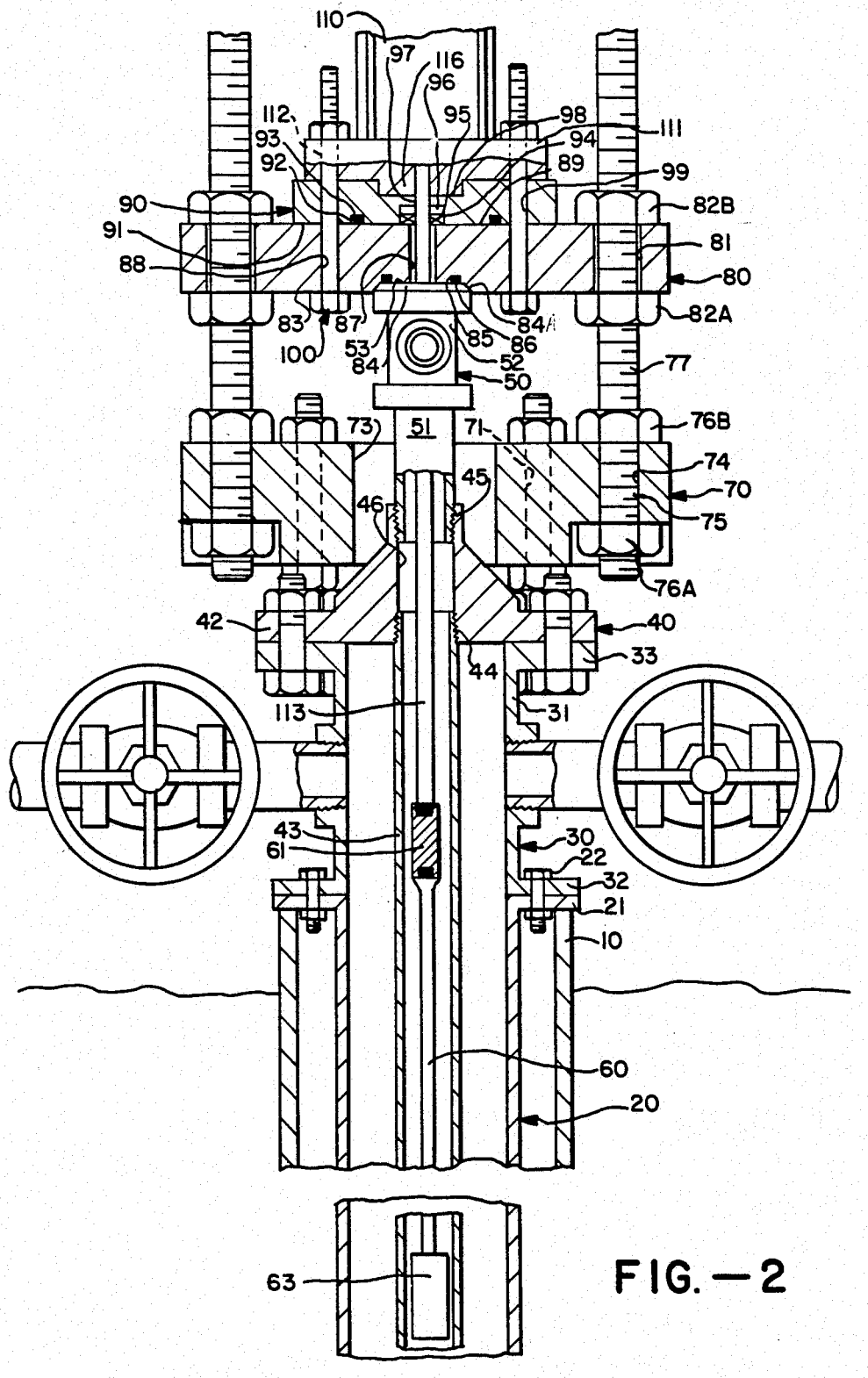
FIG. 2 is a partly sectioned elevational view of one embodiment of an oil well pump driving unit in accordance with this invention.

FIGS. 1 and 2 depict one standard way of finishing an oil well at the wellhead. In this approach, the oil well casing 20 which extends down the bore hole includes a mounting flange 21 which supports the well casing 20 on a section of production casing 10. A gas tee 30 is mounted to the well casing 20, utilizing a flange 32 which matches the flange 21 on well casing 20 and a plurality of nut and bolt fastening arrangements 22 which fasten the flange 21 and the flange 22 together. On top of the generally hollow cylindrical walls 31 of the gas tee 30, a top flange 33 is provided. This top flange 33 mates with a mounting flange 42 on a tubing hanger 40. The main body portion of 41 of tubing hanger 40 includes a center channel 46 therethrough with a bottom portion 44 of the channel threaded to receive a threaded top end section of tubing arrangement 43 which extends down the bore hole. Within the tubing arrangement 43, a sucker rod string 60 extends down to a reciprocating pump 63 at the bottom of the bore hole. A pumping tee 50 is mounted to the tubing hanger 40 using an extension nipple 51 which threads into the upper threaded section 45 of tubing hanger 40 with pumping tee 50 threading onto the top portion of the nipple 51.

Figure 7:
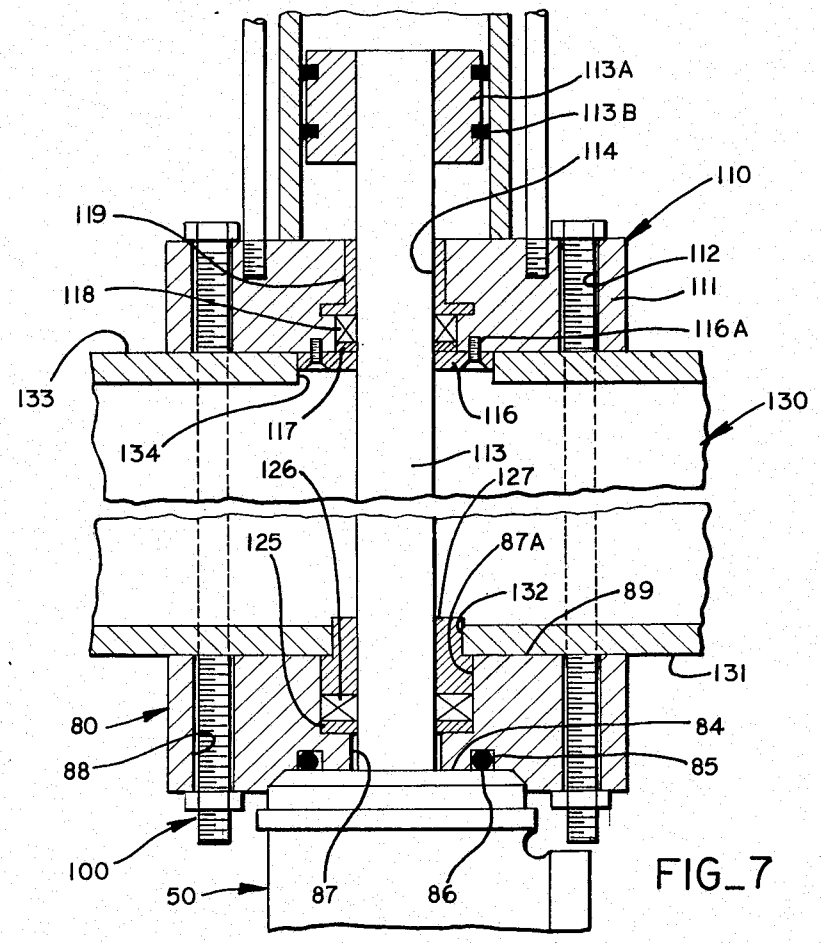
FIG. 7 is a partly sectioned elevational view of a second embodiment of an oil well pump driving unit in accordance with this invention.

In accordance with this invention the pump driving unit comprises hydraulic cylinder 110, support means for supporting the hydraulic cylinder on the pumping tee 50 which includes the structural components 70, 80, and 90, coupling means 61 for coupling the cylinder rod to the sucker rod string and a hydraulic drive/control means 120 coupled to the in/out fluid line 115 of hydraulic cylinder 110 to produce an operating cycle for the pump 63 consisting of a hydraulic power upstroke and a gravity power downstroke. The hydraulic cylinder 110 is the standard off-the-shelf type of hydraulic cylinder which includes an internal seal in the front mounting flange which precludes leakage of hydraulic fluid from the internal portion of the cylinder around the cylinder rod which extends through the front mounting flange. A typical mounting flange sealing arrangement is depicted in FIG. 7 of the drawings and will be described in detail below.

In the embodiment of this invention shown in FIGS. 1 and 2, the support means for hydraulic cylinder 110 includes a first support plate 70, a cylinder support plate assembly 80, 90, and a vertical support arrangement 77 for supporting the cylinder support plate assembly 80, 90 on the first support plate 70. The first support plate 70 and the vertical support arrangement 77 for supporting the cylinder support plate assembly 80, 90 as shown in FIGS. 1 and 2 comprise only one type of several support arrangements which may be utilized. The support arrangement shown in the above-referenced second copending Gilbertson application could also be utilized for this purpose. Accordingly, the disclosure of the above-referenced second Gilbertson patent application is hereby incorporated by reference as disclosing an alternative approach to supporting the cylinder support plate assembly 80, 90 at the wellhead. In addition, it should be understood that other support arrangements for the cylinder support plate assembly 80, 90 could be utilized, including structural arrangements which involve supporting the cylinder support plate assembly on a concrete foundation surrounding the production casing 10.

Figure 6:
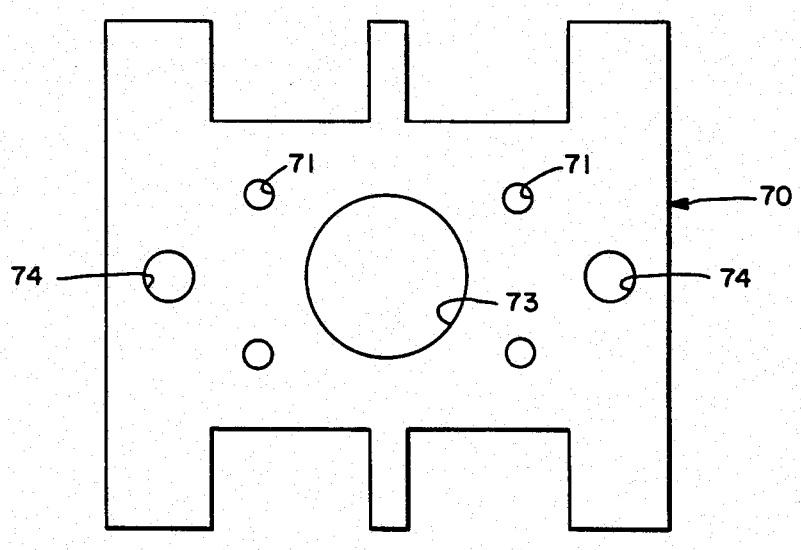
FIG. 6 is a top plan view of a support plate component of a pump driving unit in accordance with this invention taken along the line 6—6 in FIG. 1.

Referring now to FIGS. 1, 2 and 6, the structural details and mounting arrangement of the first support plate 70 will be discussed. First support plate 70 is basically a thick steel plate which is mounted directly on the tubing hanger 40 using a plurality of apertures 71 which register with some of the series of apertures which extend through the flanges 42 and 33 on the tubing hanger 40 and the gas tee 30, respectively. Accordingly, four mounting bolt and nut arrangements 72 are provided for securing the first support plate 70 on tubing hanger 40 and gas tee 30. Spacer bolts 72A are provided to space the bottom surface of first support plate 70 sufficiently above the flange 42 on the tubing hanger 40 to provide clearance between the central channel 73 through support plate 70 and the outer surface of the tubing hanger 40.

To support the cylinder support plate assembly 80, 90 on top of pumping tee 50, a pair of large diameter threaded steel rods 77 are received in apertures 74 extending through first support plate 70 with bolts 76A and 76B fastening the threaded rods 77 thereto. The threaded rods 77 extend through apertures 81 in base plate 80 which is maintained in position on threaded rod 77 using a pair of bolts 82A and 82B on each rod. The diameter of the aperture 81 is slightly greater than that of the threaded rod 77 to permit some horizontal adjustment of the position of base plate 80 with respect to the position of pumping tee 50.

Figure 4:
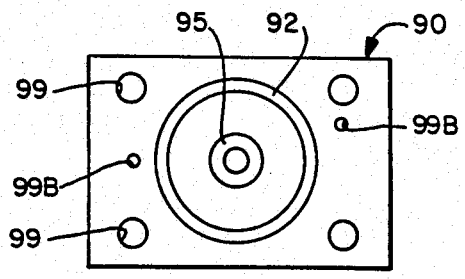
FIG. 4 is a bottom plan view of a cylinder plate component of this invention depicted in FIG. 3 and taken along the line 4—4 in FIG. 1.
Figure 5:
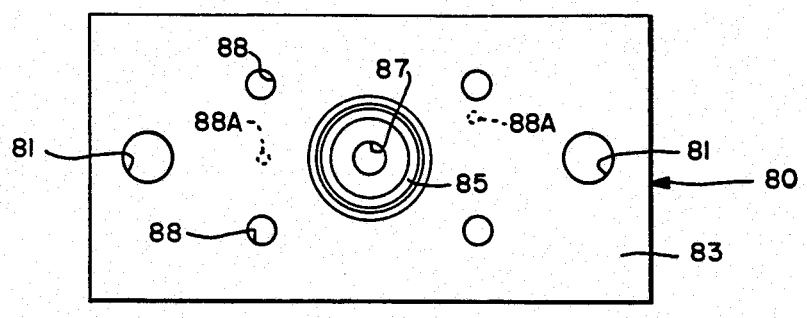
FIG. 5 is a bottom plan view of a base plate component of a pump driving unit in accordance with this invention taken along the line 5—5 in FIG. 1.

Referring now to FIGS. 1 and 2 in connection with FIG. 5, the structure and mounting arrangement of base plate 80 will be described. A cylinder rod channel 87 extends through base plate 80 in a central region thereof. The bottom surface 83 of base plate 80 has a cylindrical recess 84 machined therein with sloping side walls 84A. The pumping tee 50 has a top surface 53 which has been machined smooth and flat and a top edge surface 54 which has been machined with a chamfer. The configuration of the machined recess 84 in base plate 80 precisely matches that of the machined top and edge surfaces of pumping tee 50 so that registration of the base plate 80 on top of pumping tee 50 is automatically achieved. The recess 84 is carefully machined to be coaxial with the cylinder rod channel 87 so that the axis of cylinder rod channel 87 will exactly align with the axis of pumping tee 50 and correspondingly with the axis of tubing arrangement 43 when base plate 80 is mounted on top of pumping tee 50. A circular groove 85 is machined into the recess 84 and carries an O-ring 86 which provides a fluid-tight seal between the surface of recess 84 and the top surface 53 of pumping tee 50. The top surface 89 of first support plate 80 is machined flat to mate precisely with a machined bottom surface 91 of cylinder plate 90. Alignment pin holes 88A as shown in FIG. 5 in dashed lines are formed in the top surface 89 of first support plate 80 and match with the alignment pin holes 99B formed in the bottom surface 91 of cylinder plate 90 as shown in FIG. 4.

Referring now to FIGS. 1 to 4, the structure and mounting of cylinder plate 90 will be described. As already mentioned, cylinder plate 90 is mounted on first support plate 80 in a precisely registered manner using alignment pins in the respective alignment pin apertures 88A and 99B. A cylinder rod channel 97 extends through the central region of cylinder plate 90 and is formed with cylinder plate 90 in position on base plate 80 so that precise axial alignment of the cylinder channel 87 in support plate 80. A cylindrical recess 94 is machined into the bottom surface 91 of cylinder plate 90. Cylindrical recess 94 is adapted to house a brass wiping ring 96 and a gasket 95 which provides a fluid-tight seal against the surface of cylinder rod 113. A circular groove 92 is machined into bottom surface 91 of cylinder plate 90 for receiving an O-ring 93 to provide a fluid-tight seal between the bottom surface 91 of cylinder plate 90 and the top surface 89 of support plate 80.

Figure 3:
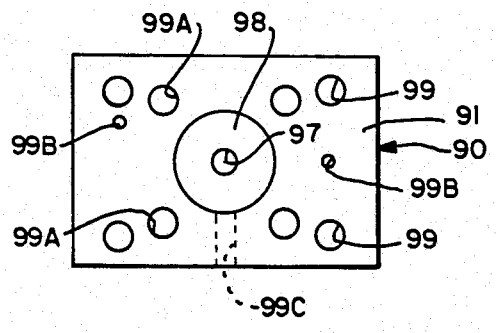
FIG. 3 is a top plan view of a cylinder plate component of a pump driving unit in accordance with this invention taken along the line 3—3 in FIG. 1.

In the top surface of cylinder plate 80 a cylindrical recess 98 is machined surrounding the cylinder rod channel 97. This cylindrical recess 98 is machined precisely to the configuration of the nose piece 116 on the mounting flange 111 of hydraulic cylinder 110. In this fashion hydraulic cylinder 110 is precisely registered in its horizontal position with respect to cylinder plate 80. Accordingly, when hydraulic cylinder 110 is mounted on cylinder plate 90 and cylinder plate 90 is mounted in registered fashion on support plate 80 and support plate 80 is mounted in registered fashion on top of pumping tee 40, precise axial alignment of the cylinder rod 113 with respect to the cylinder rod channels 87 and 97 is provided and corresponding axial alignment with the pumping tee 50 and the tubing arrangement 43 is provided. A nut and bolt arrangement generally designated 100 is provided for fastening the mounting flange 111 of hydraulic cylinder 110 to cylinder plate 90 and support plate 80. Apertures 88 in support plate 80 and apertures 99 in cylinder plate 90 are aligned with apertures 112 in mounting flange 111 of hydraulic cylinder 110 so that four nut and bolt arrangements 100 (or threaded rod and nut arrangements) may be utilized to fasten these components together. As shown in FIG. 3, recesses 99A are provided in the top surface of cylinder plate 90 to provide clearance for fastening nuts (not shown) which hold the mounting flange 111 on hydraulic cylinder 110. A monitor channel 99C is provided between the recess 98 and one side of the cylinder plate 90 in order to detect any leakage of fluid past the gasket 95 when the pump driving unit is in operation.

As shown in FIG. 1, a hydraulic drive/control unit 120 is coupled to the in/out fluid line 115 of hydraulic cylinder 110. This hydraulic drive/control unit may comprise the hydraulic drive/control unit disclosed in the second copending Gilbertson patent application which is incorporated by reference herein. Although only a single hydraulic cylinder 110 is shown in FIGS. 1 and 2, it should be understood that a second hydraulic cylinder (not shown) mounted in tandem with hydraulic cylinder 110 may be provided with respective cylinder rods of the two units coupled together to a standard accumulator arrangement (not shown). In this manner the second tandem cylinder and the accumulator arrangement connected thereto serve essentially as a counterweight which reduces the hydraulic fluid pressure required for the hydraulic upstroke of the pump driving unit. In other words, energy is stored in the accumulator during the gravity power downstroke and is at least partly recovered during the hydraulic power upstroke of the unit.

The assembly of the pump driving unit in accordance with this invention is relatively simple and straightforward. The first support plate 70 is mounted to the tubing hanger and gas tee combination as shown in FIGS. 1 and 2. The large threaded rods 77 are mounted to the first support plate 70 using the bolts 76A and 76B on each side. Then the bolts 82A are threaded onto the top of the threaded rods 77 to be in position to support the base plate 80. The cylinder plate 90 is then placed on the base plate 80 in its registered position using location pins in alignment apertures 88A and 99B. Then, with cylinder 110 lying on its side, the base plate 80 and the cylinder plate 90 are mounted to the mounting flange 111 using a nut and bolt arrangement 100 (or a threaded rod and mounting nut arrangement). Prior to placing the cylinder plate 90 on top of the support plate 80, the O-ring 93, the gasket 95 and bronze wiping ring 96 are placed in their proper locations.

After cylinder 110 has been mounted to the cylinder plate 90 and the support plate 80, this assembly is lifted by a hoist to a vertical orientation above the threaded rods 77. The assembly is lowered onto the threaded rods 77 with the apertures 81 in base plate 80 receiving the threaded rod and with the assembly coming to rest on the bottom mounting bolts 82A. While the base plate 80 is near the top of the threaded rod 77, the cylinder rod 113 is connected to the sucker rod string using the connector 61. The bolts 82A are then utilized to lower the base plate 80 and the components attached thereto until the recess 84 machined into the bottom of base plate 80 comes to rest in a registered position on the machined top and chamfered edge surfaces of the pumping tee 50. The base plate 80 is lowered only to the point where the O-ring 86 is sufficiently compressed to provide a fluid-tight seal between the base plate and pumping tee surfaces. In this manner the principal weight of the hydraulic cylinder 110 and the pumping load on the cylinder rod 110 is maintained on the threaded rods 77 rather than on the pumping tee 50. Once this assembly has been completed, the pump driving unit is ready to operate to pump fluid from the well.

Although a preferred embodiment of apparatus of this invention has been disclosed in the drawings and description, it should be understood that numerous changes could be made without departing from the principles of the invention. As previously mentioned, other types of support arrangements for the cylinder support assembly 80, 90 could be provided, including the arrangement shown in the above-referenced second copending Gilbertson application. Furthermore, it should be understood that various structural changes could be made in the cylinder support assembly and still achieve the sealing relationships which eliminate the need for a separate stuffing box. One alternative would be to eliminate the cylinder plate 90 and instead machine a stepwise recess in the top surface 89 of base plate 80 to contain the gasket and wiping ring and to provide registration of the nose of the hydraulic cylinder in an accurately machined recess. O-ring sealing could then be provided between the top surface 89 of support plate 80 and the mounting flange 111 of hydraulic cylinder 110.

Figure 8:
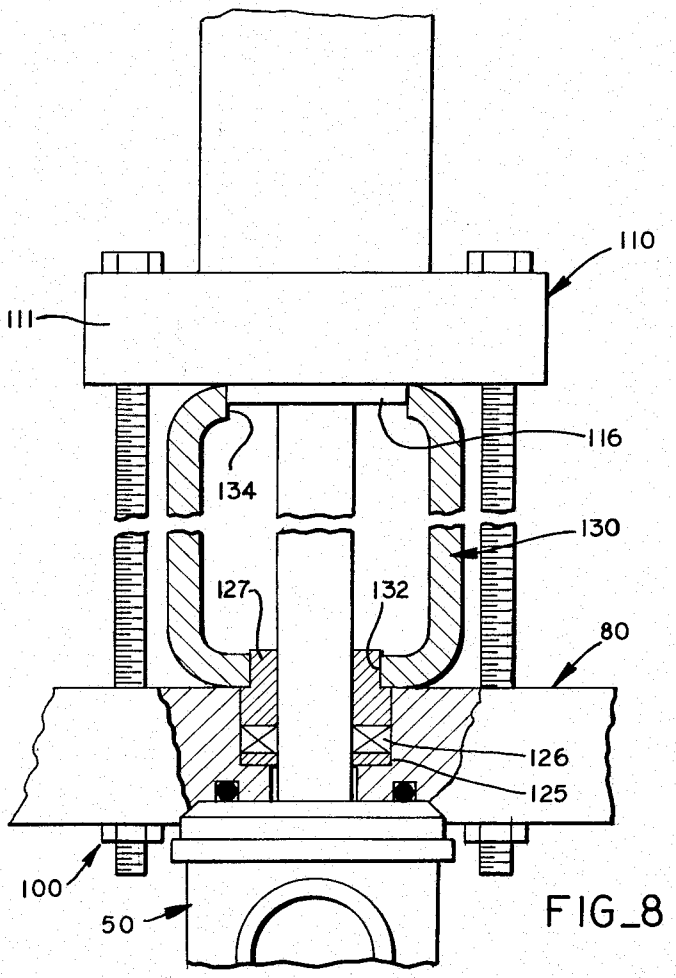
FIG. 8 is a partly sectioned side elevational view of the second embodiment depicted in FIG. 7.

Various other types of fluid sealing arrangements could also be employed. For example, FIGS. 7 and 8 illustrate another embodiment of this invention in which a different placement of the second cylinder rod fluid sealing arrangement is utilized. The configuration of the support plate 80 in this embodiment is substantially the same as that in the embodiment shown in FIGS. 1 and 2 except that a cylinder rod sealing arrangement is located adjacent the cylinder rod channel 87 in the top region of the support plate. This cylinder rod sealing arrangement includes a metallic rod wiper 125, a fluid sealing gasket 126 and a pilot location bushing 127, all of which fit into a recess 87A in the block 80. A top portion of the pilot location bushing 127 extends above the top surface 89 of the block 80 and is received within an aperture 132 in the cylinder support element 130.

The cylinder support element 130 is a section of box tubing which, as shown in FIG. 8, extends between the mounting bolts of the mounting bolt arrangement 100. In this manner, the cylinder support element 130 is precisely located on the support block 80 so that both the apertures 132 and 134 are concentrically aligned with the center axis of the pumping tee 50. The top aperture 134 receives the nose 116 which extends forward of the mounting flange 111 of the hydraulic cylinder 110. In this manner the hydraulic cylinder is accurately located in position on the cylinder support element 130 and the cylinder rod 113 will extend in an aligned fashion through the pumping tee 50.

As shown in FIG. 7, the hydraulic cylinder 110 is a standard off-the-shelf type of hydraulic cylinder which includes a front mounting flange 111 having a fluid sealing arrangement mounted therein comprising a cylinder rod wiping element 117, a cylinder rod sealing element or gasket 118, and a rod bearing 119. This fluid sealing and bearing arrangement precludes escape of hydraulic fluid from the internal portion of the hydraulic cylinder 110 as the piston 113A and cylinder rod 113 reciprocate in and out of the cylinder.

The cylinder rod sealing arrangement including the gasket 126 mounted within the support block 80 precludes any leakage of well fluid from the pumping tee around the cylinder rod as it reciprocates through the support block 80. The metal rod wiping washer 125 assists in wiping any large contaminating particles off the cylinder rod before it encounters the sealing gasket 126. The pilot location bushing 127 assists in maintaining cylinder rod alignment and avoidance of any side-loading on the cylinder due to any slight misalignment of the cylinder rod with the central axis of the pumping tee 50 and the tubing string which extends down the bore hole.

It will thus be appreciated that the two embodiments of this invention disclosed in FIGS. 1 and 2 and FIGS. 7 and 8 have the common feature of permitting a standard hydraulic cylinder to be mounted in a convenient fashion directly over the pumping tee of the well in an aligned manner such that the cylinder rod itself can be utilized to directly couple to the rod string without requiring a polished rod therebetween. In addition, the cylinder rod sealing arrangement positioned within the support block 80 serves in place of the standard stuffing box typically mounted on top of the pumping tee to seal against leakage of well fluid around the polished rod.

The various embodiments of this invention thus serve to facilitate mounting a standard hydraulic cylinder having its own internal fluid sealing arrangement on a standard pumping tee in an axially aligned manner. By locating the sealing arrangement within the support block 80 the open end of the cylinder support element 130 permits visual inspection of the cylinder rod to determine whether well fluid is leaking around the gasket 126. If such leakage is spotted, it is a simple matter to raise the entire cylinder support arrangement off the pumping tee a sufficient distance so that the start of the sucker rod string will emerge from the top of the pumping tee and be held in place while the cylinder rod is disconnected therefrom. Then the support block 80 can be removed so that the gasket 126 can be replaced.

It should be apparent that the cylinder support element 130 could take various alternative forms from the box tubing depicted in FIGS. 7 and 8. For example the cylinder support element could be a solid steel piece having a cylinder receiving channel formed therethrough together with recesses for the pilot location bushing 127 and the nose 116 of the cylinder 110. A rod inspection aperture could then be drilled through the solid cylinder support element into the cylinder rod channel for visual inspection of the cylinder rod to detect well fluid thereon. However, the box tubing arrangement provides a preferred low cost approach to the cylinder support function since only a pair of registered apertures need be drilled through the top and bottom surfaces to receive the pilot location bushing 127 and the cylinder nose 116.

It should be understood that numerous additional changes could be made in the embodiment of the invention described above without departing from the scope of the invention as claimed in the following claims.

What is claimed is:

1. In an oil well pumping apparatus which includes a submerged reciprocating pump mounted at the well bottom in a tubing arrangement communicating with the wellhead and positioned generally concentric with the well casing, a sucker rod string extending through said tubing arrangement and connected in driving relation with said pump, and a tubing hanger mounted to said well casing for holding said tubing arrangement, a pump driving unit comprising:

a hydraulic cylinder including a cylinder rod, a mounting flange, an in/out fluid line, and a first cylinder rod sealing means positioned within said mounting flange to preclude leakage of hydraulic fluid around said cylinder rod as it moves in and out through said mounting flange;

a pumping tee mounted on top of said tubing hanger and having a top end wall with an aperture therethrough;

an integral cylinder support and stuffing box assembly including a cylinder support plate assembly having a bottom surface configuration adapted to mount in fluid sealing and registered relation on said top end wall of said pumping tee, a top surface configuration adapted to mount said mounting flange of said hydraulic cylinder in registration with said pumping tee, a cylinder rod channel extending between said top and bottom surface for admitting said cylinder rod into said pumping tee, and a second cylinder rod sealing means disposed adjacent said cylinder rod channel for providing a seal against leakage of well fluid between said reciprocating cylinder rod and said cylinder rod channel;

coupling means for coupling said cylinder rod to said sucker rod string; and hydraulic drive/control means coupled to said in/out fluid line for operating said hydraulic cylinder to produce an operating cycle for said pump consisting of a hydraulic power upstroke and a gravity power downstroke.

2. In an oil well pumping apparatus which includes a submerged reciprocating pump mounted at the bottom of the well in a tubing arrangement communicating with the wellhead, a sucker rod string extending through said tubing arrangement and connected in driving relation with said pump, a combined pump driving, pumping tee and stuffing box arrangement comprising:

a hydraulic cylinder, including a cylinder rod and an in/out fluid line;

a pumping tee mounted on the casing of the well at the wellhead and communicating with said tubing arrangement, said pumping tee having a machined flat top surface and a top edge with a machined chamfer thereon;

an integral cylinder support and stuffing box arrangement mounted on top of said pumping tee;

coupling means for coupling said cylinder rod to said sucker rod string;

hydraulic drive/control means coupled to said in/out fluid line for operating said hydraulic cylinder to produce an operating cycle for said pump consisting of a hydraulic power upstroke and a gravity power downstroke;

said integral cylinder support and stuffing box arrangement including a cylinder support plate assembly having a cylinder rod channel extending therethrough and means for mounting said cylinder support plate assembly on top of said pumping tee;

said cylinder support plate assembly comprising a base plate and a cylinder plate carried on said base plate with cooperating support plate on said base plate, a generally cylindrical recess being formed in a bottom surface of said base plate with a configuration matching the machined top surface and chamfered edge of said pumping tee for providing registration between said base plate and said pumping tee; a circular groove being formed in said cylindrical recess and carrying an O-ring for fluid sealing of said bottom surface of said base plate against the top surface of said pumping tee; a top surface of said cylinder support plate having a recess formed therein closely matching the cylindrical nose on the mounting flange of said hydraulic cylinder to provide accurate registration of said cylinder on said cylinder plate; and a cylindrical recess being formed in a bottom surface of said cylinder plate surrounding said cylinder rod channel and carrying a gasket therein for providing a fluid seal against said reciprocating cylinder rod.

3. A kit of parts for mounting a hydraulic cylinder directly over and in line with a tubing string extending below a tubing hanger mounted on the casing at a wellhead and providing a self-sealing cylinder mounting and pumping tee arrangement, said kit comprising:

a pumping tee having a flat machined top surface and a chamfer machined on a top edge surface thereof;

means for mounting said pumping tee on top of said tubing hanger with said machined top surface prearranged distance above said tubing hanger;

a cylinder support plate assembly adapted to mount directly on top of said pumping tee and to have a hydraulic cylinder mounted thereto in axial alignment with said pumping tee and said tubing string; and support means for supporting said cylinder support plate assembly on top of and in contact with said pumping tee;

said cylinder support plate comprising a base plate and a cylinder plate carried on said base plate with cooperating registration means for precisely locating said cylinder support plate on said base plate, said base plate and said cylinder plate each having a cylinder rod channel formed therein between top and bottom surfaces thereof and in axial registration with each other, a cylindrical recess being formed in a bottom surface of said base plate surrounding said cylinder rod channel and having a configuration matching the machined top surface and chamfered edge of said pumping tee for providing registration between said base plate and said pumping tee, a circular groove being formed in said cylindrical recess and being adapted to carry an O-ring for fluid sealing of said bottom surface of said base plate against the top surface of said pumping tee when positioned together, a top surface of said cylinder support plate having a recess formed therein closely matching the cylindrical nose on the mounting flange of a hydraulic cylinder adapted to provide accurate registration of said cylinder on said cylinder plate when mounted thereto, a bottom surface of said cylinder plate having a cylindrical recess formed therein surrounding said cylinder rod channel and adapted for carrying a gasket therein for providing a fluid seal against said reciprocating cylinder rod, said cylinder plate and said base plate each having apertures therethrough separated from said cylinder rod channel and adapted to mount said mounting flange of said hydraulic cylinder thereon and to fasten said cylinder plate and said base plate together utilizing a threaded fastener arrangement.

4. In an oil well pumping apparatus which includes a submerged reciprocating pump mounted at the bottom of the well in a tubing arrangement communicating with the wellhead, a sucker rod string extending through said tubing arrangement and connected in driving relation with said pump, and a pumping tee having a top end wall with an aperture therethrough mounted on the casing of the well at the wellhead and communicating with said tubing arrangement, a pump driving unit comprising:

a hydraulic cylinder, including a cylinder rod, a mounting flange, an in/out fluid line, and a first cylinder rod sealing means positioned within said mounting flange to preclude leakage of hydraulic fluid around said cylinder rod as it moves in and out through said mounting flange;

support means mounted on said top end wall of said pumping tee for supporting said mounting flange of said hydraulic cylinder with the axis of said cylinder rod aligned with the axis of said pumping tee and said tubing arrangement; said support means including a fluid sealing arrangement engaging a top surface of said top end wall of said pumping tee for precluding leakage of well fluid thereat and a second cylinder rod sealing means engaging said cylinder rod for precluding leakage of well fluid around said cylinder rod;

coupling means for coupling said cylinder rod to said sucker rod string; and a hydraulic drive/control means coupled to said in/-out fluid line for operating said hydraulic cylinder to produce an operating cycle for said pump consisting of a hydraulic power upstroke and a gravity power downstroke.

5. Apparatus as claimed in claim 4, wherein said support means further includes a cylinder rod inspection port positioned between said second cylinder rod sealing means and said mounting flange of said hydraulic cylinder for permitting inspection of said cylinder rod for presence of any substantial quantities of well fluid indicating leakage of said second cylinder rod sealing means.

6. Apparatus as claimed in claim 4, wherein said support means comprises:

a first support plate mounted at the wellhead below said pumping tee and adapted to carry the weight of said hydraulic cylinder and the pumping load thereon;

a cylinder support plate assembly adapted to be mounted on said pumping tee; and a vertical support arrangement for supporting said cylinder support plate assembly on said first support plate;

said cylinder support plate assembly having a bottom surface with registration means formed thereon for producing registration between said cylinder support plate and said pumping tee and carrying said fluid sealing arrangement to seal said bottom surface against the top surface of said pumping tee, a cylinder rod channel extending through said cylinder support plate assembly to receive said cylinder rod with said second cylinder rod sealing means carried on said cylinder support plate assembly surrounding said cylinder rod channel to provide a fluid seal between the edge of said cylinder rod channel and said cylinder rod.

7. Apparatus as claimed in claim 6, wherein said cylinder support plate assembly comprises a base plate mounted against a top surface of said pumping tee and a cylinder support means carried on said base plate; each of said base plate and said cylinder support means having a channel extending therethrough for receiving said cylinder rod; said base plate including said second cylinder rod sealing means carried within said channel; and said cylinder support means having an inspection aperture extending between an outer surface thereof and said cylinder rod channel to permit inspection of said cylinder rod for presence of any substantial quantities of well fluid indicating leakage of said second cylinder rod sealing means.

8. Apparatus as claimed in claim 6, wherein a gas tee having a top mounting flange is mounted on the casing of said well at the wellhead, a tubing hanger with a matching bottom flange is mounted to said mounting flange of said gas tee using a plurality of bolt and nut arrangements extending through registered apertures in said mounting flanges of said gas tee and said tubing hanger, said pumping tee being mounted to the top of said tubing hanger at a prearranged distance thereabove; said first support plate comprises a thick steel plate having a central aperture therein through which said tubing hanger and pumping tee extend and an arrangement of mounting apertures adapted to align with said apertures in said mounting flanges of said gas tee and tubing hanger to secure said support plate on said tubing hanger with co-operating fastener arrangements; said cylinder support plate assembly and said first support plate having at least two co-operatively registered peripheral apertures therethrough adapted to receive at least a pair of threaded rods cooperating with mounting bolts threaded on said rods for supporting said cylinder support plate assembly on top of said pumping tee.

9. Apparatus as claimed in claim 6, wherein said pumping tee has a top surface which has been machined flat and a top edge with a chamfer machined thereon, said registration means comprises a cylindrical recess machined into said bottom surface of said cylinder support plate assembly with a configuration matching the top surface of said pumping tee and angled sidewalls matching said chamfered top edge of said pumping tee; said sealing arrangement comprises a circular groove formed in said cylindrical recess and carrying an O-ring for sealing against said machined top surface of said pumping tee; said cylinder support plate assembly comprises a base plate and a cylinder plate carried on said base plate with cooperating registration means for locating said cylinder plate with respect to said base plate; said second cylinder rod sealing means comprises a cylindrical recess formed in a bottom surface of said cylinder plate and a gasket carried in said cylindrical recess to provide a sliding fluid seal for said cylinder rod extending therethrough; said top surface of said cylinder plate having a recess formed therein closely matching the configuration of the cylindrical nose on the mounting flange of said hydraulic cylinder to provide accurate registration of said cylinder on said cylinder plate; said base plate and said cylinder plate having a plurality of apertures therethrough in registration with mounting apertures in said cylindrical mounting flange of said cylinder for receiving bolts to fasten said cylinder on said cylinder plate and to fasten said base plate and said cylinder plate together.

10. Apparatus as claimed in claim 9, wherein a circular groove and O-ring sealing arrangement is provided between said top surface of said base plate and said bottom surface of said cylinder plate, a bronze wiping ring is carried in said cylindrical recess in said bottom surface of said cylinder plate to provide a wiping action to remove foreign material from the surface of said cylinder rod before entering said hydraulic cylinder, and a leak monitor channel is provided between said recess formed in said top surface of said cylinder plate and an external side wall of said cylinder plate for monitoring any leakage of oil between said cylinder rod and said gasket.

* * * * *